US007625320B2

(12) United States Patent
Wehrell

(10) Patent No.: US 7,625,320 B2
(45) Date of Patent: Dec. 1, 2009

(54) SWING TRAINING APPARATUS AND METHOD

(75) Inventor: Michael Al Wehrell, Tampa, FL (US)

(73) Assignee: Michael A. Wehrell, Tampa, FL (US)

( * ) Notice: Subject to any disclaimer, the term of this patent is extended or adjusted under 35 U.S.C. 154(b) by 0 days.

(21) Appl. No.: 10/892,196

(22) Filed: Jul. 16, 2004

(65) Prior Publication Data

US 2005/0043156 A1 Feb. 24, 2005

Related U.S. Application Data

(60) Provisional application No. 60/487,227, filed on Jul. 16, 2003.

(51) Int. Cl.
*A63B 21/02* (2006.01)
*A63B 21/04* (2006.01)
*A63B 69/36* (2006.01)

(52) U.S. Cl. ..... 482/92; 482/124; 482/130; 473/215

(58) Field of Classification Search ..... 482/92, 482/123, 124, 69, 129, 130; 434/252; 473/207, 473/215–6

See application file for complete search history.

(56) References Cited

U.S. PATENT DOCUMENTS 2,893,736 A * 7/1959 Tesi ..... 473/216
4,551,108 A 11/1985 Bass
4,593,909 A * 6/1986 Anselmo et al. ..... 473/216
4,863,163 A 9/1989 Wehrell
4,968,028 A 11/1990 Wehrell
5,048,836 A * 9/1991 Bellagamba ..... 473/216
5,050,871 A 9/1991 Douglas et al.
5,242,339 A * 9/1993 Thornton ..... 482/8
5,512,029 A * 4/1996 Barnard et al. ..... 482/129
5,597,376 A 1/1997 Bode et al.
5,653,665 A * 8/1997 Neeley ..... 482/106
5,803,822 A * 9/1998 Pursell ..... 473/216
5,924,933 A * 7/1999 Pacheco ..... 473/216
5,941,807 A * 8/1999 Cassidy et al. ..... 482/146
6,120,418 A * 9/2000 Plough ..... 482/69
6,554,747 B1 * 4/2003 Rempe ..... 482/38
6,612,845 B1 * 9/2003 Macri et al. ..... 434/247

* cited by examiner

*Primary Examiner*—Loan H Thanh
*Assistant Examiner*—Allana Lewin
(74) *Attorney, Agent, or Firm*—Duan Morris LLP

(57) ABSTRACT

A resistance swing training apparatus and method for providing resistance opposing the rotation of the hips of athletes performing sports-specific movements such as the golf or baseball swing. The apparatus provides the resistance by attaching tethers such elastic cords to a harness worn around the waist of the athlete in a configuration that allows the athlete to perform the sports-specific movement at optimum speed. In one embodiment the apparatus includes a base forming the training area and a pair of training modules for providing the elastic cords for attachment to the hips of the athlete. The lateral spacing and elevation of the elastic cords may be adjusted to fit the athlete. The resistance may also be adjusted in a wide range of resistances to fit the athlete.

14 Claims, 23 Drawing Sheets

Removable Power Module Design

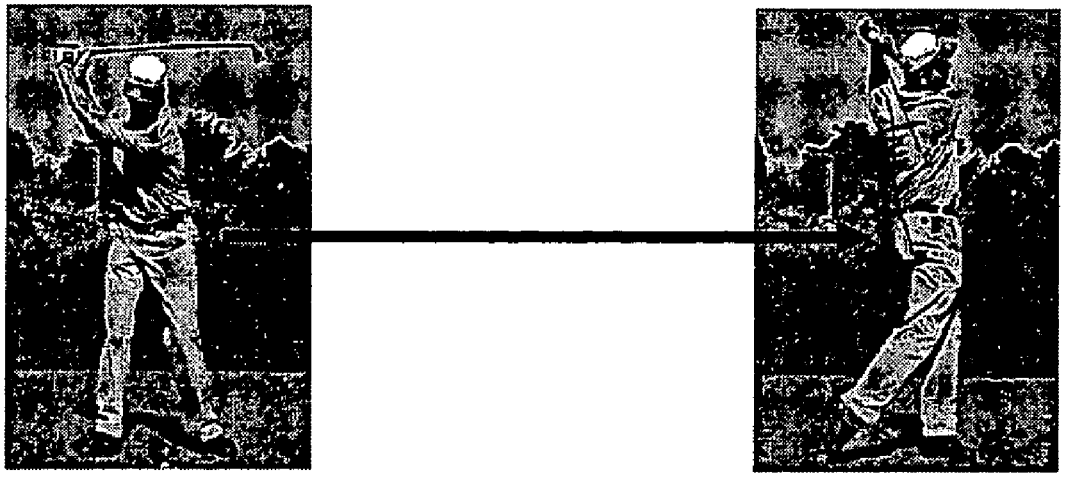
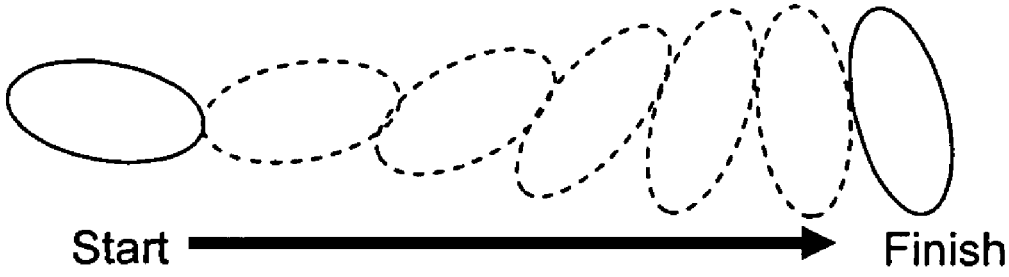
Figure 11 – Hip Rotation

SWING TRAINING APPARATUS AND METHOD

CLAIM OF PRIORITY

This application claims the priority of U.S. Provisional Patent Application No. 60/487,227 filed Jul. 16, 2003.

RELATED APPLICATIONS

This application is related to U.S. patent application Ser. No. 10/892,568 and issued Feb. 24, 2009 as U.S. Pat. No. 7,494,453 entitled "Physical Training Apparatus And Method" filed Jul. 16, 2004, by the inventor hereof, the content of which is incorporated herein by reference.

BACKGROUND OF THE INVENTION

The present invention relates to a physical training apparatus and method for training athletes such as golfers and baseball players who rely on generating power by rotation of the hips. More particularly, it relates to a swing training apparatus and method for providing forces of either constant or varying magnitude opposing the rotation of the hips through the range of motion during the golf or baseball swing.

Physical training and conditioning have long been recognized as desirable for improving various motor skills to thereby improve the performance of an athlete, the rehabilitation of a physical therapy patient, or the overall physical well-being of the trainee. Training with resistance while performing specific movements with the body has been found to be very effective in improving various physical abilities such as functional strength, running speed, first-step quickness, jumping ability, and kicking ability. Such resistance training is increasingly becoming favored over training with heavy weights using slow non-sports specific motions.

For example, if an athlete wants to run faster it has been found to be more beneficial to apply light resistance to the leg muscles while running than by performing a press with the legs with heavy weights. Both of these training methods will strengthen the leg muscles of the athlete, however, the high-speed training by providing light resistance while running allows the athlete to generate more power at high speeds since the muscle is conditioned with resistance at high speeds. Training the muscles using slow movement with resistance promotes power generation at slow speeds since the muscle is conditioned at slow speeds. Both training methods are important to most athletes. However, for athletic performance optimization at high speeds the muscles must be physically and neurologically trained at high speeds. The term "training vector" as used herein shall mean a force opposing the motion of a portion of a trainee through a predetermined range of motion. The magnitude and direction of a training vector may be relatively constant or may vary through the predetermined range of motion.

U.S. Pat. Nos. 4,968,028 and 4,863,163 entitled "Vertical Jump Exercise Apparatus" issued to the inventor of the present invention each disclose resistance training apparatus for vertical jump training and conditioning. The prior art system disclosed in the Wehrell patents applies two training vectors having relatively constant magnitude to the hips of the trainee for applying resistance to the legs while performing the jumping motion.

A later modification of the exercise apparatus disclosed in the Wehrell patents provided relatively constant resistance to the back of the knees of a trainee performing a running motion by attaching the elastic members of the exercise apparatus to detachable leg harnesses worn by the trainee. This embodiment provided resistance for training the hip flexors of the trainee at high speeds.

Similarly, if an athlete wants to generate more power by rotation of the hips, it will be beneficial to apply light resistance to the rotation of the hips as the athlete performs a specific athletic movement such as swinging a golf club or a baseball/softball bat. Such rotational training of the hips may be beneficial to other athletes such as soccer players, place kickers, track and field athletes, tennis players, and athletes of other racket sports.

One prior art system illustrated in FIG. 1 provides pulleys with resistance bands attached to walls to provide lateral resistance vectors A and B. The walls and/or cords in this configuration will interfere with the path of a golf club when performing a natural swing and the vectors A and B fail to provide a relatively constant training vector to each hip during the full range of motion in a golf swing.

There remains a need for a physical training apparatus that applies training vectors opposing the rotation of the hips while performing sports specific movements.

Accordingly, it is an object of the present invention to obviate many of the deficiencies in the prior art and to provide a novel physical training apparatus and method.

It is another object of the present invention to provide a novel physical training apparatus and method for providing training vectors opposing the rotation of the hips of an athlete.

It is still another object of the present invention to provide a novel physical training apparatus and method for providing training vectors of relatively constant magnitude opposing the hips of an athlete performing a golf swing.

It is yet another object of the present invention to provide a novel physical training apparatus and method for providing training vectors of relatively constant magnitude opposing the hips of an athlete performing a baseball or softball swing.

It is another object of the present invention to provide a novel physical training apparatus and method for providing at least two training vectors opposing rotation of the lower body of an athlete performing a sports specific athletic movement.

It is still another object of the present invention to provide a novel physical training apparatus and method for providing multiple training vectors opposing rotation of the hips and shoulders of an athlete performing a sports specific movement.

It is a further object of the present invention to provide a novel swing training apparatus and method for improving the club head speed in a golf swing.

It is yet a further object of the present invention to provide a novel physical training apparatus and method for improving the bat speed in a baseball swing.

These and many other objects and advantages of the present invention will be readily apparent to one skilled in the art to which the invention pertains from a perusal of the claims, the appended drawings, and the following detailed description of the preferred embodiments.

BRIEF DESCRIPTION OF THE DRAWINGS

FIGS. 11 and 12 are illustrations showing the various positions of the hips of a golfer during a golf swing.

DESCRIPTION OF PREFERRED EMBODIMENTS

With reference to the figures where like elements have been given like numerical designations to facilitate an understanding of the present invention, the various embodiments of the physical training apparatus of the present invention are described.

According to one aspect of the present invention, a physical training apparatus and method are provided for providing training vectors opposing the rotation of the hips of an athlete performing sports specific movements such as swinging a golf club or baseball/softball bat.

Figure 1:
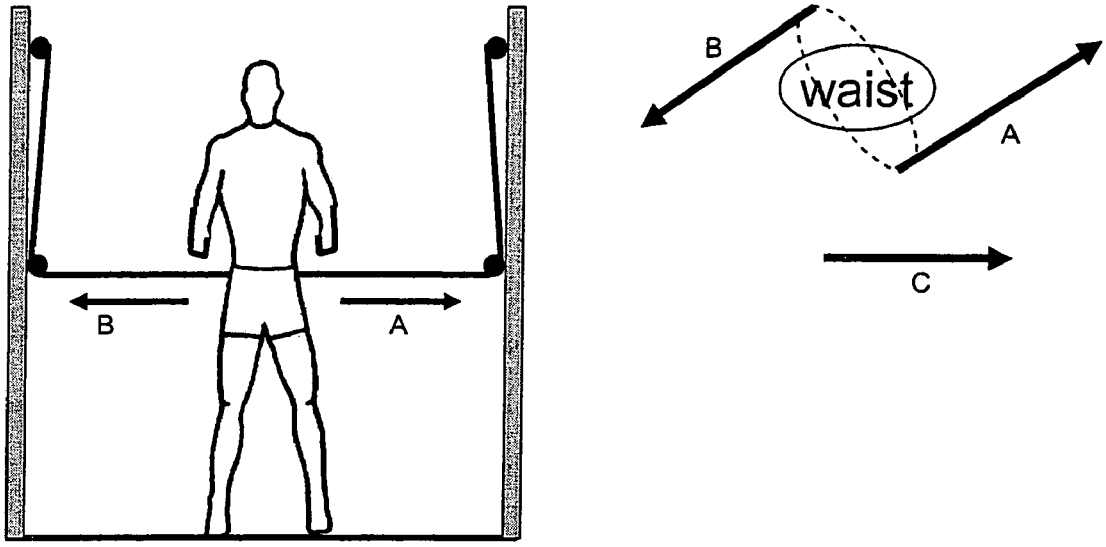
FIGURE 1 PRIOR ART
FIG. 1 is a front view of a prior art training system with a user in a standing position showing a restraining means providing a specified resistance with reference to the user.
Figure 2:
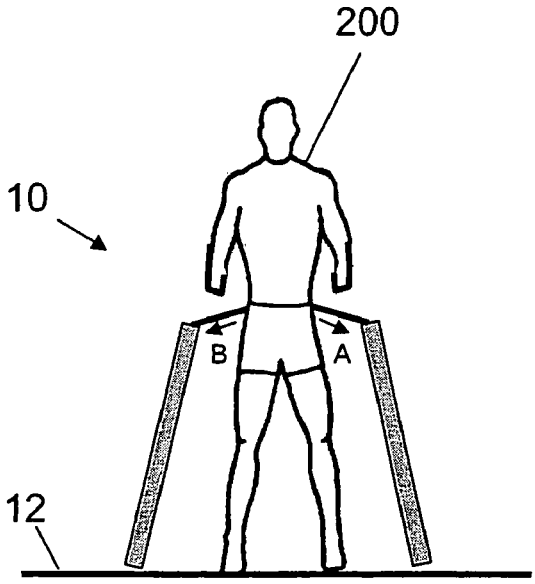
FIG. 2 is a front view of an embodiment of the present invention with a user in a standing position showing a restraining means providing a specified resistance with reference to the user.

FIG. 2 illustrates a physical training apparatus according to the present invention. With reference to FIG. 2, the physical training apparatus 10 comprises a platform or base 12 that forms a training surface on which the trainee 200 may train. The resistance training assemblies 20,30 may be mounted to the base 12 and provide the training vectors A,B that oppose the rotation of the hips of the trainee 200.

Figure 3:
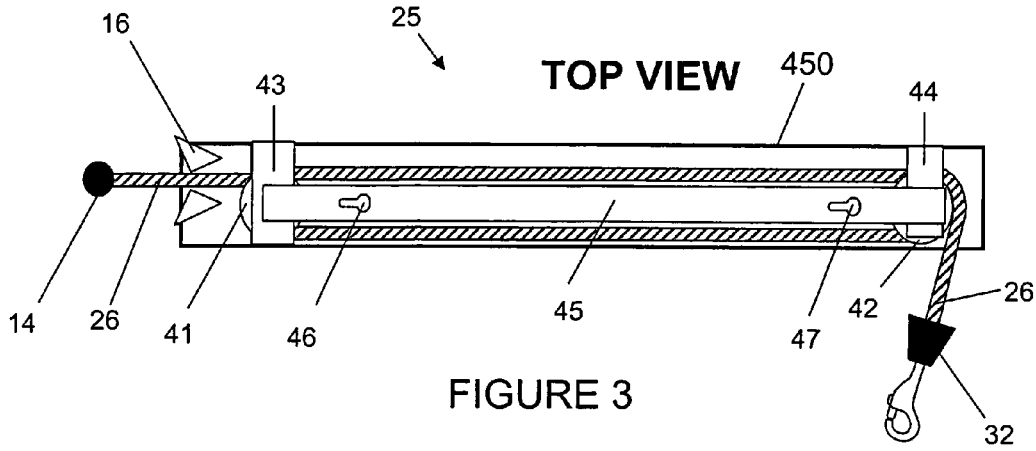
FIG. 3 is a top plan view of a training module of the present invention.
Figure 4:
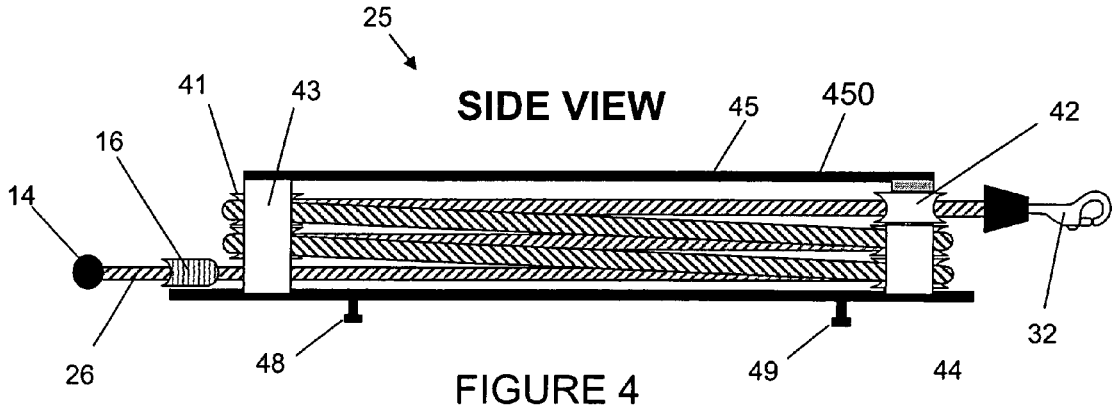
FIG. 4 is a side view of the training module of FIG. 3.
Figure 5:
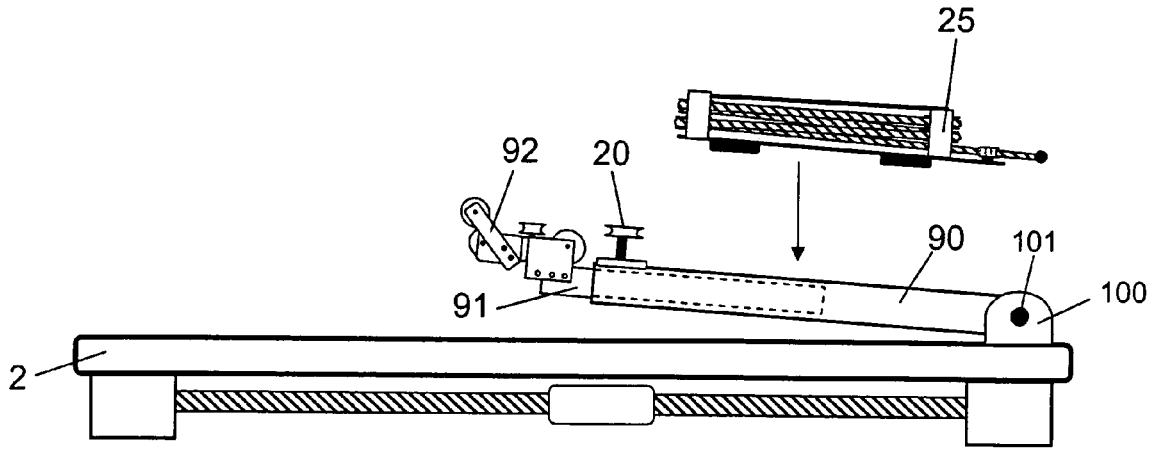
FIG. 5 is a side view of an alternative embodiment of the present invention showing a resistance training assembly.
Figure 6:
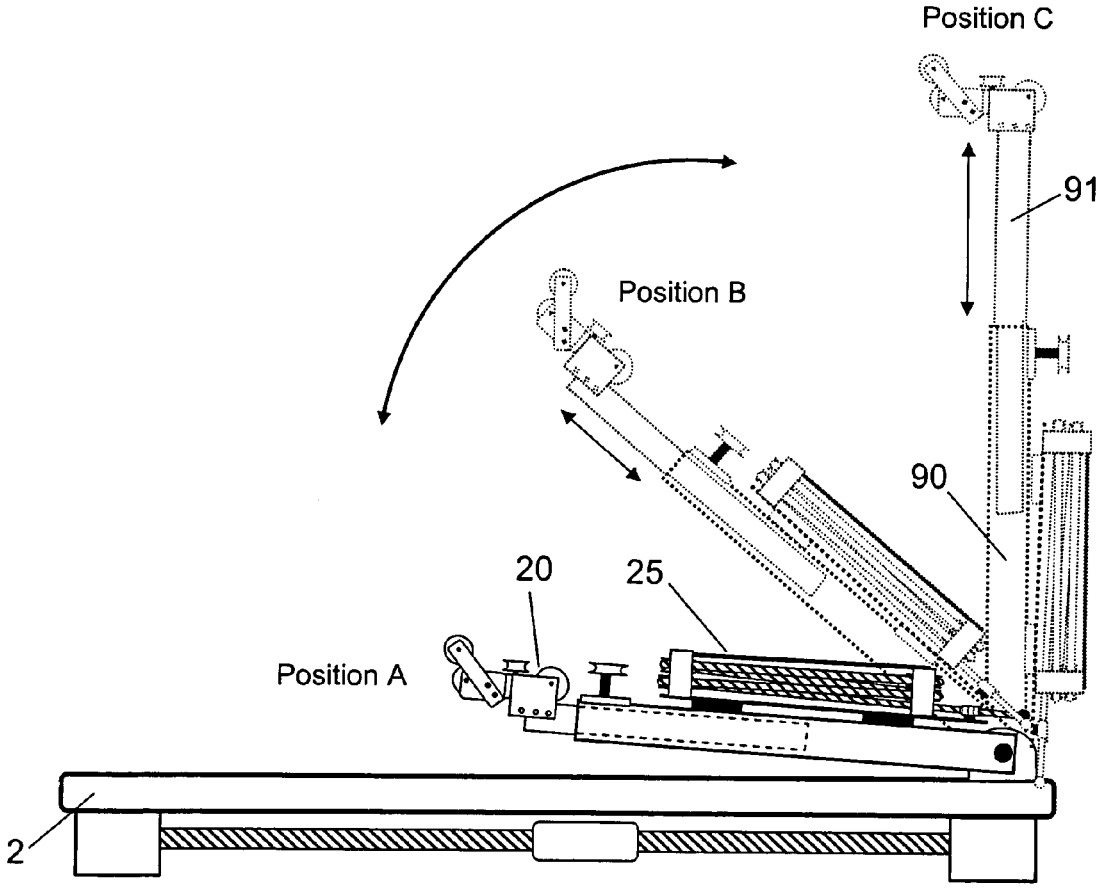
FIG. 6 is a side view of the alternative embodiment of FIG. 5 illustrating various positions of the resistance training assembly.

The resistance training assemblies 20,30 include one or more training modules 25 for providing a training vector. FIG. 3 and FIG. 4 illustrate the top and side views of the training module 25. With reference to FIG. 3 and FIG. 4, the training module 25 comprises a rigid frame 450 that carries two stacked pulley assemblies 41,42. Each of the stacked pulley assemblies includes one or more stacked pulleys. The rigid frame 450 includes upper and lower elongated members 45 and pulley assembly mounting members 43,44. A suitable anchor 16 such as a cam cleat is mounted on the lower elongated member 45. The spaced pulley assemblies 41,42 provide a path for routing the elastic member 26 therebetween so that an elastic member many times the length of elongated members 45 may be contained within the training module 25. The elastic member 26 is secured near one end by the anchor 16 and is attached to a connector 32 at the other end. The effective length of the elastic member 26, i.e., the length of the member between the anchor 16 and the connector 32, may be selected by extracting the end 114 of the elastic member 26 from the module 25 and then securing the member 26 with the anchor 16. The magnitude of the training vector will vary with the effective length of the elastic member 26. The connector is adapted to be connected to a harness worn around the waist of the trainee. The elastic member 26 may have sufficient length so that the magnitude of the training vector provided to the trainee wearing the harness is relatively constant through the range of motion of the harness. A single module may also include two or more elastic members having different diameters for providing a wider range of resistive force.

FIGS. 5-9 illustrate embodiments of the physical training apparatus according to the present invention. With reference to FIGS. 5-9, the origin for one or more training vectors may be selectively varied in three dimensions and the elevation above the training surface of the origins of two or more training vectors may be different. The resistance training assembly 20 may be formed by mounting a training module 25 on a ridged frame member 90 and including a telescoping frame member 91 and pivoting cord routing assembly 92. The frame member 90 may be attached at one end to the base 12 or other surface using the base fixture 100. The frame member 90 can pivot in the base 100 about the axis pin 101. The other end of the frame member 90 may be elevated from the base and secured at any angle relative to the surface of the base 12.

The positions A, B and C illustrate elevation angles of about five, forty-five and ninety degrees respectively.

The position of telescoping frame member 91 relative to the frame member 90 may be fixed at various positions so that the distance between the base 100 and the routing assembly 92 may vary.

Figure 7:
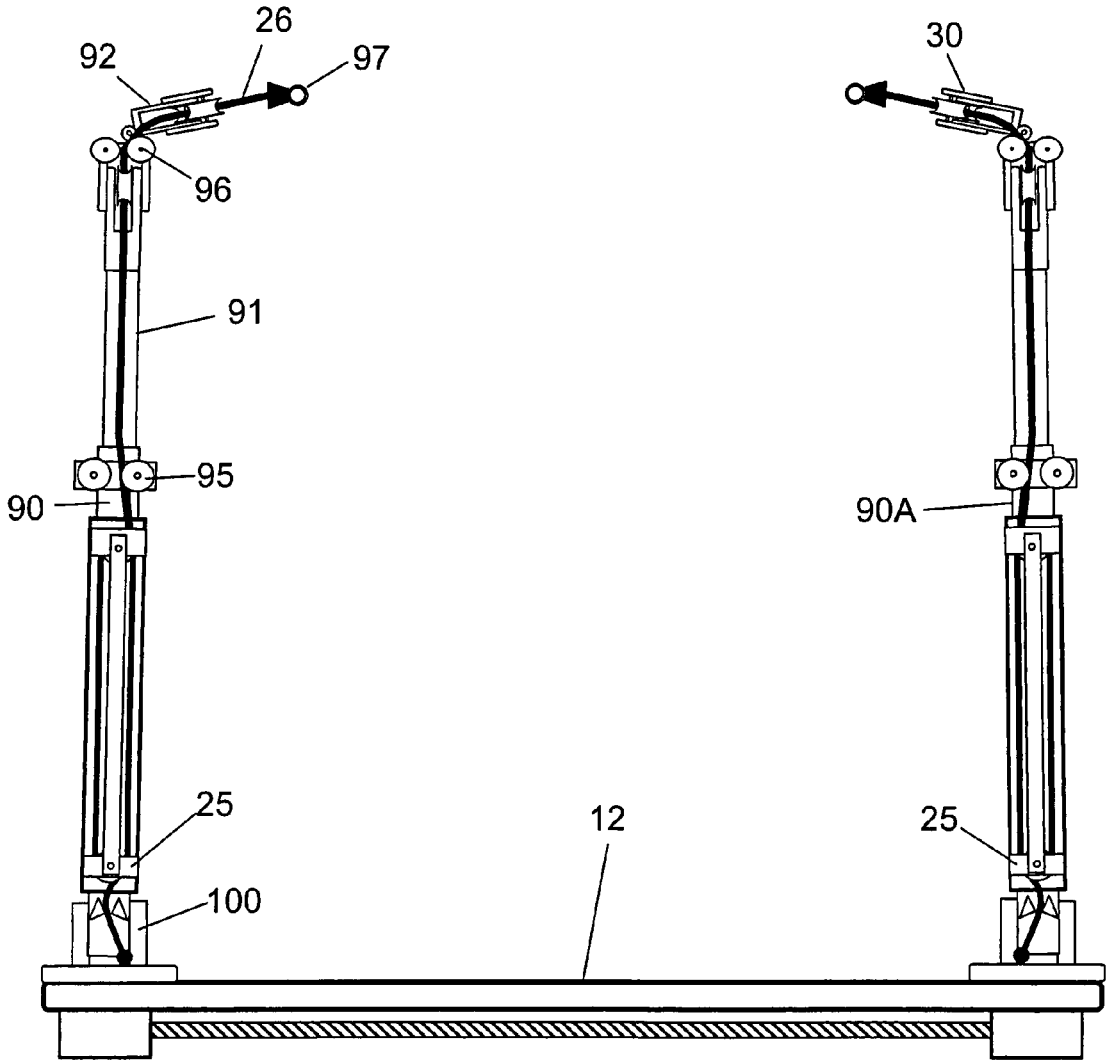
FIG. 7 is a front view of an alternative embodiment of FIG. 5 with the resistance training assemblies elevated at a right angle with the base.

With reference to FIG. 7, the resistance training assemblies 20,30 are elevated to an angle of about 90 degrees relative to the surface of the base 12. The elastic member 26 is directed out of training module 25 through the pulley units 95 and 96 and then through the pivoting pulley assembly 92. The elastic member 26 is attached at one end to the connector 97 for attachment to the selected part of the body of a trainee supported by the base 12.

Figure 8:
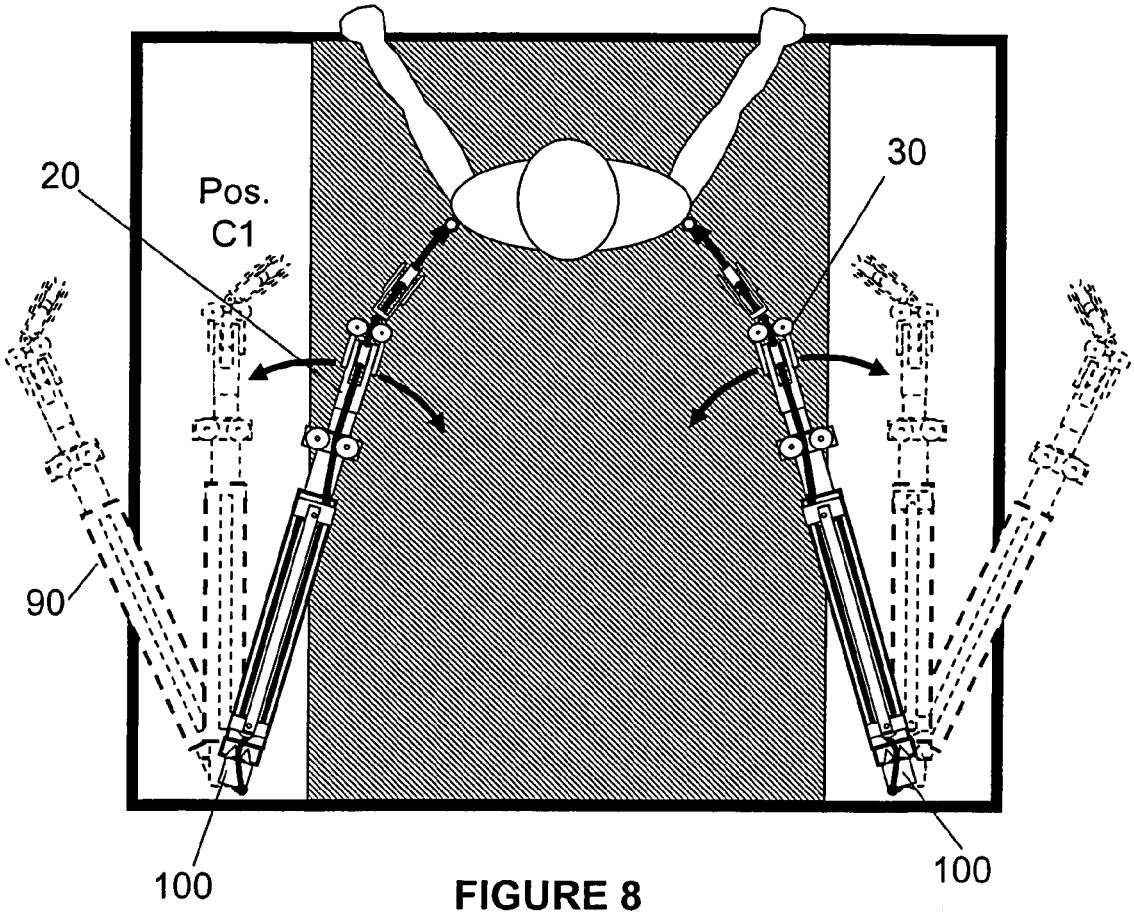
FIG. 8 is a top plan view of another embodiment of the present invention illustrating different positions of the resistance training assemblies.
Figure 9:
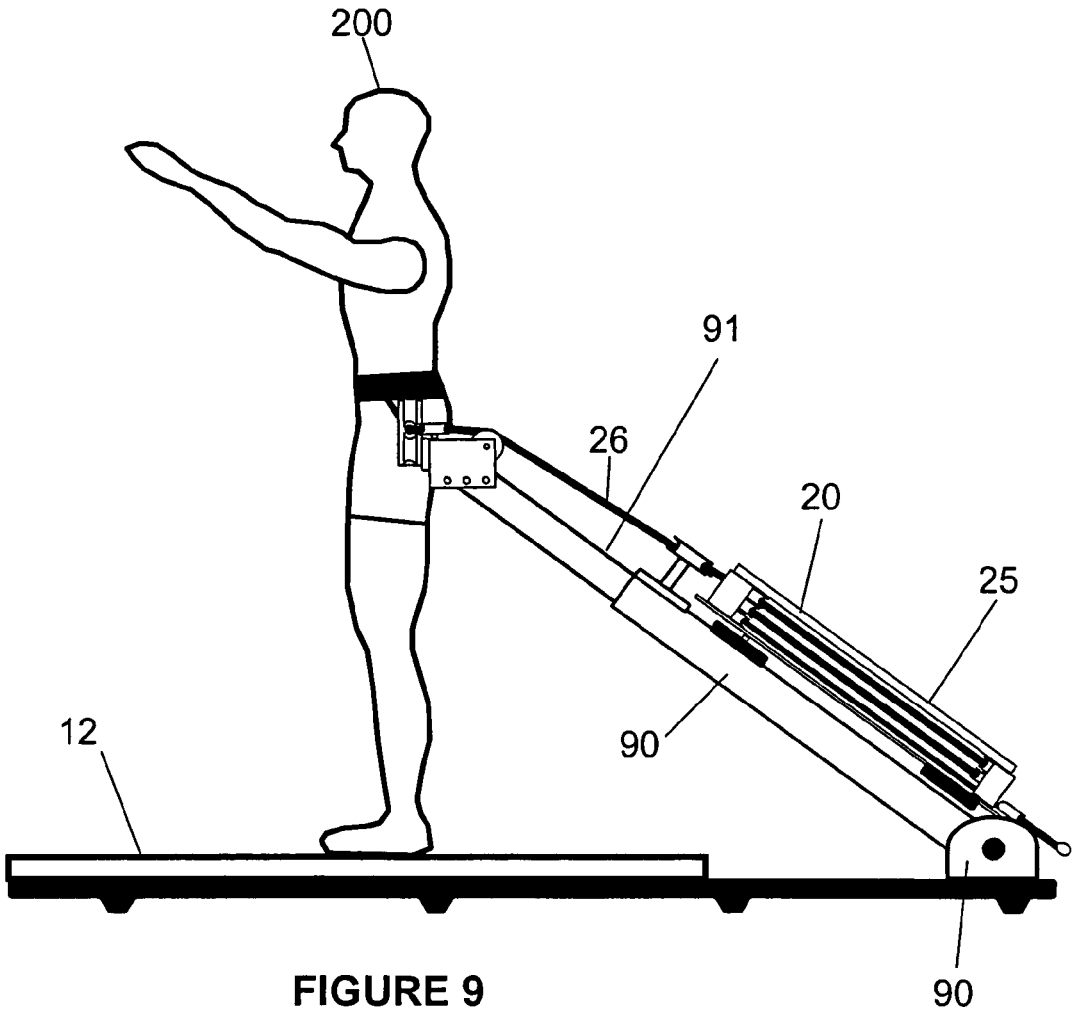
FIG. 9 is a side view of the embodiment of FIG. 8.

With reference to FIG. 8, the base fixture 100 may rotate around an axis perpendicular to the plane of the upper surface of the base 12 so that the resistance training assemblies 20,30 may be fixed at various angles relative to the position C1. An adjustment means (not shown) enables the user to rotate and fix the base fixture 100 at various positions relative to the surface on which the base fixture 100 is attached. Alternatively, the base fixtures 100 may be mounted on a rail (not shown) extending laterally behind the trainee so that the position of the fixtures 100 may be selected. For example, as an alternative to pivoting the resistance training assemblies as illustrated in FIG. 8, the base fixtures 100 may be position a distance apart equally to about should width of the trainee. FIG. 9 illustrates a side view of the physical training apparatus shown in FIG. 8.

Figure 10:
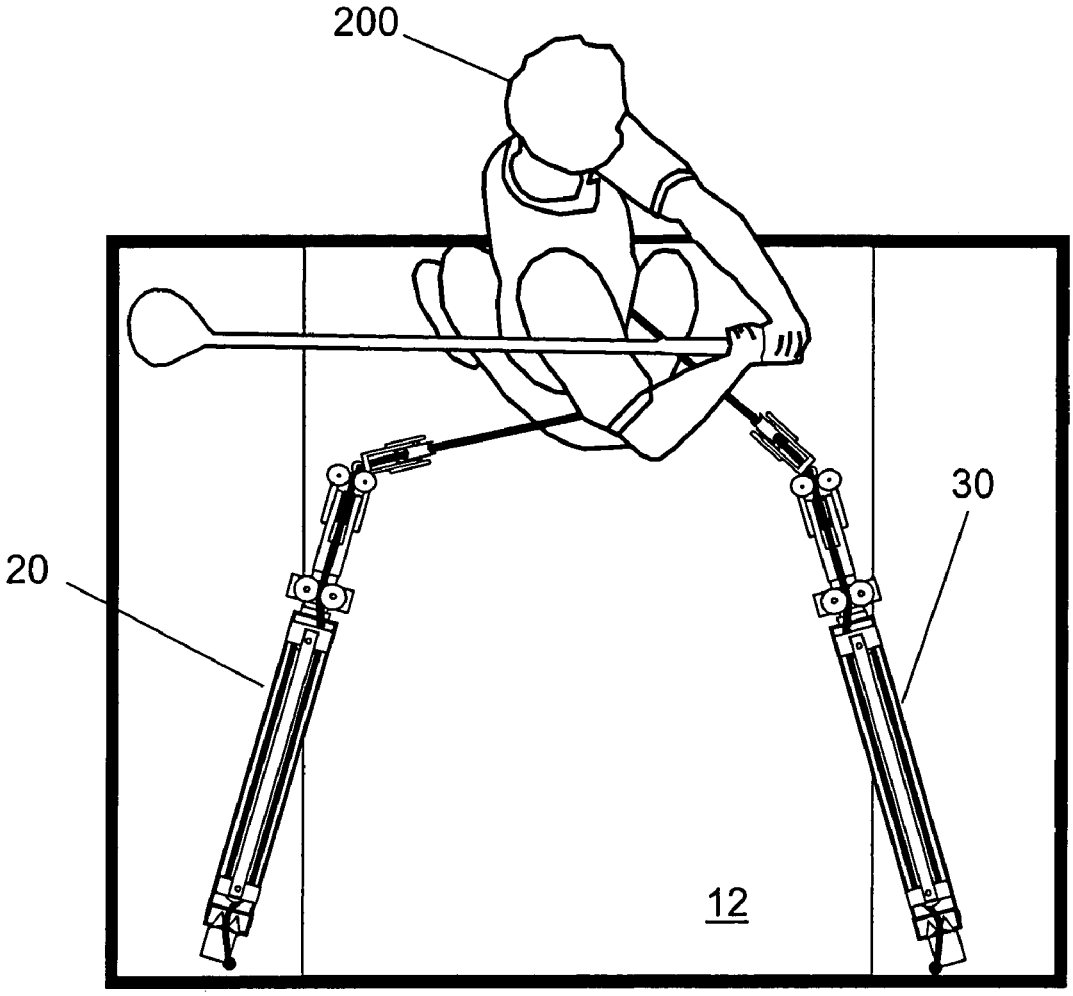
FIG. 10 is a top plan view an embodiment of the present invention with a user performing a golf swing showing a restraining means providing a specified resistance with reference to the user.

FIG. 10 illustrates the embodiment of the physical training apparatus according to the present invention shown in FIGS. 8 and 9 providing training vectors to the hips of a trainee 200 performing a golf swing.

Figure 12:
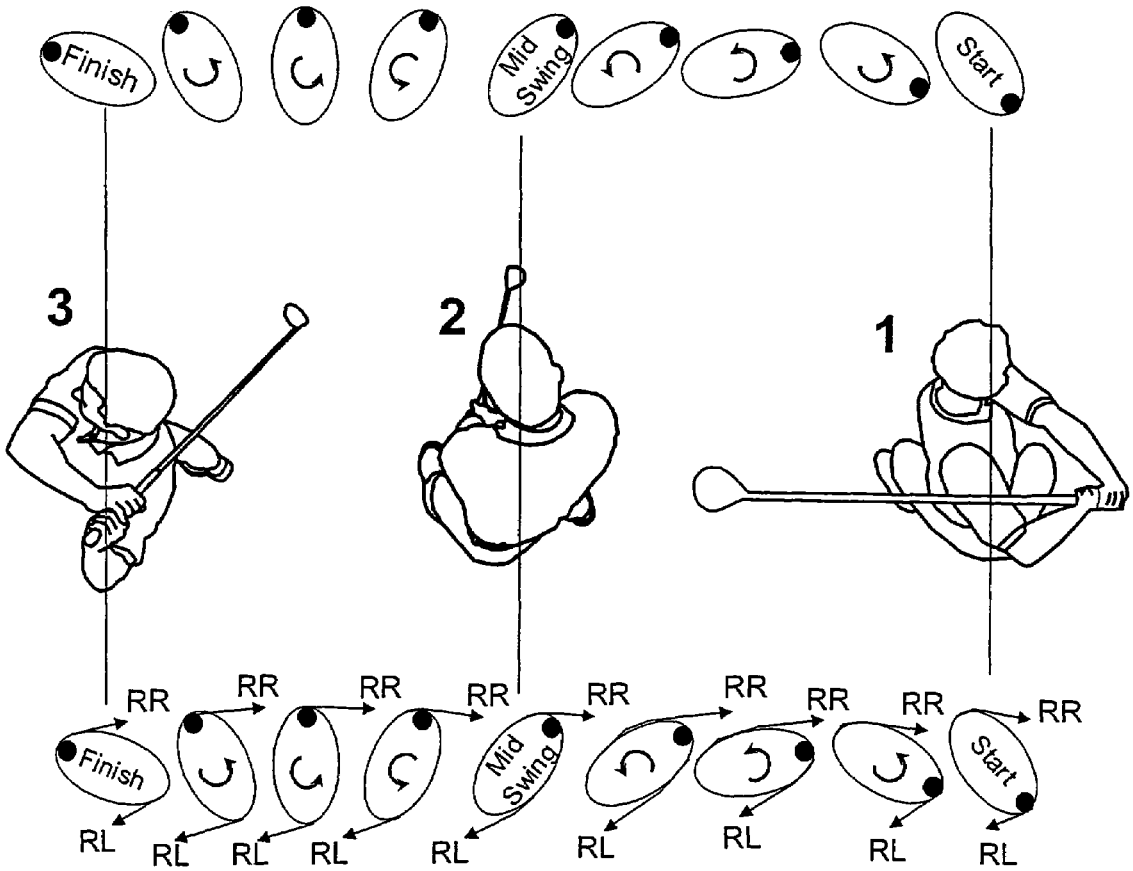
Figure 13:
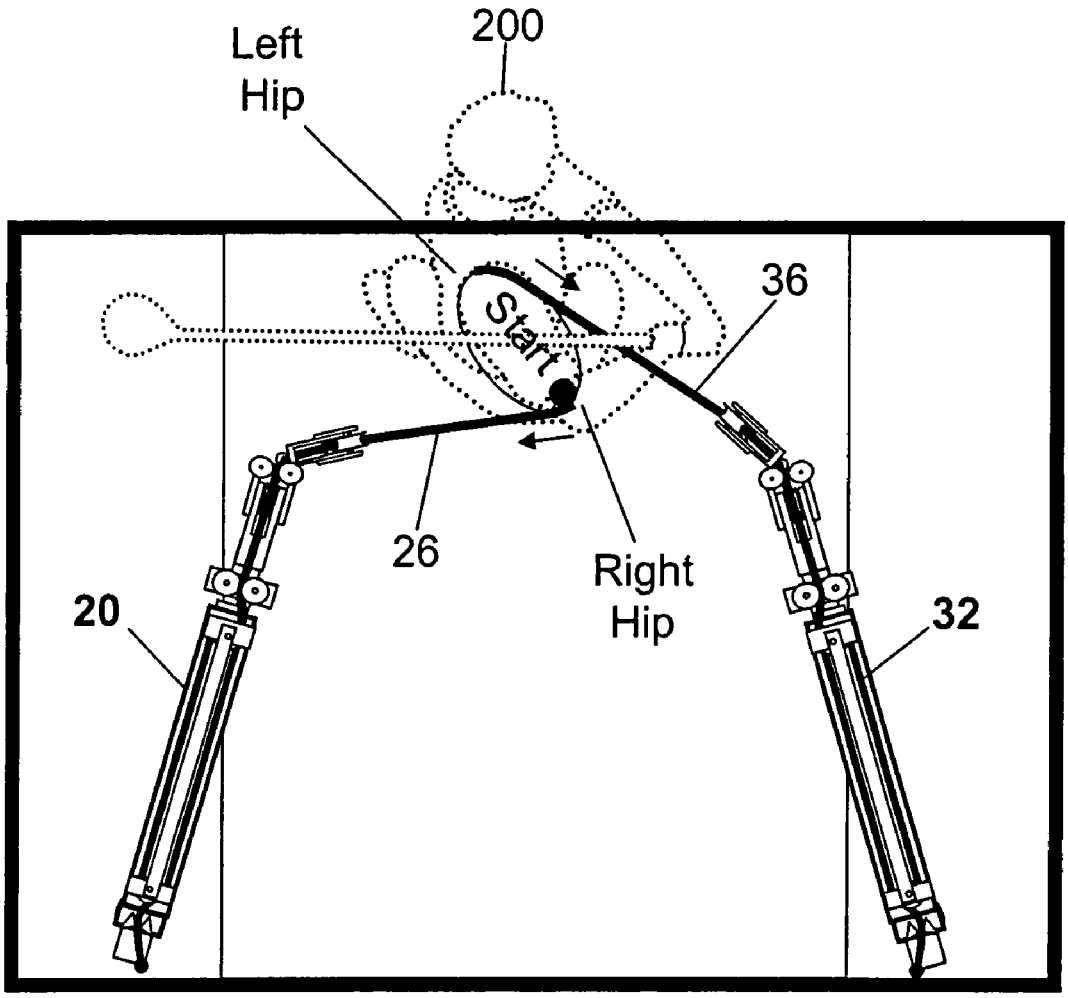
FIG. 13 is a top plan view of an embodiment of the present invention with a user in the backswing position of FIGS. 11 and 12 showing a restraining means providing a specified resistance with reference to the user.
Figure 14:
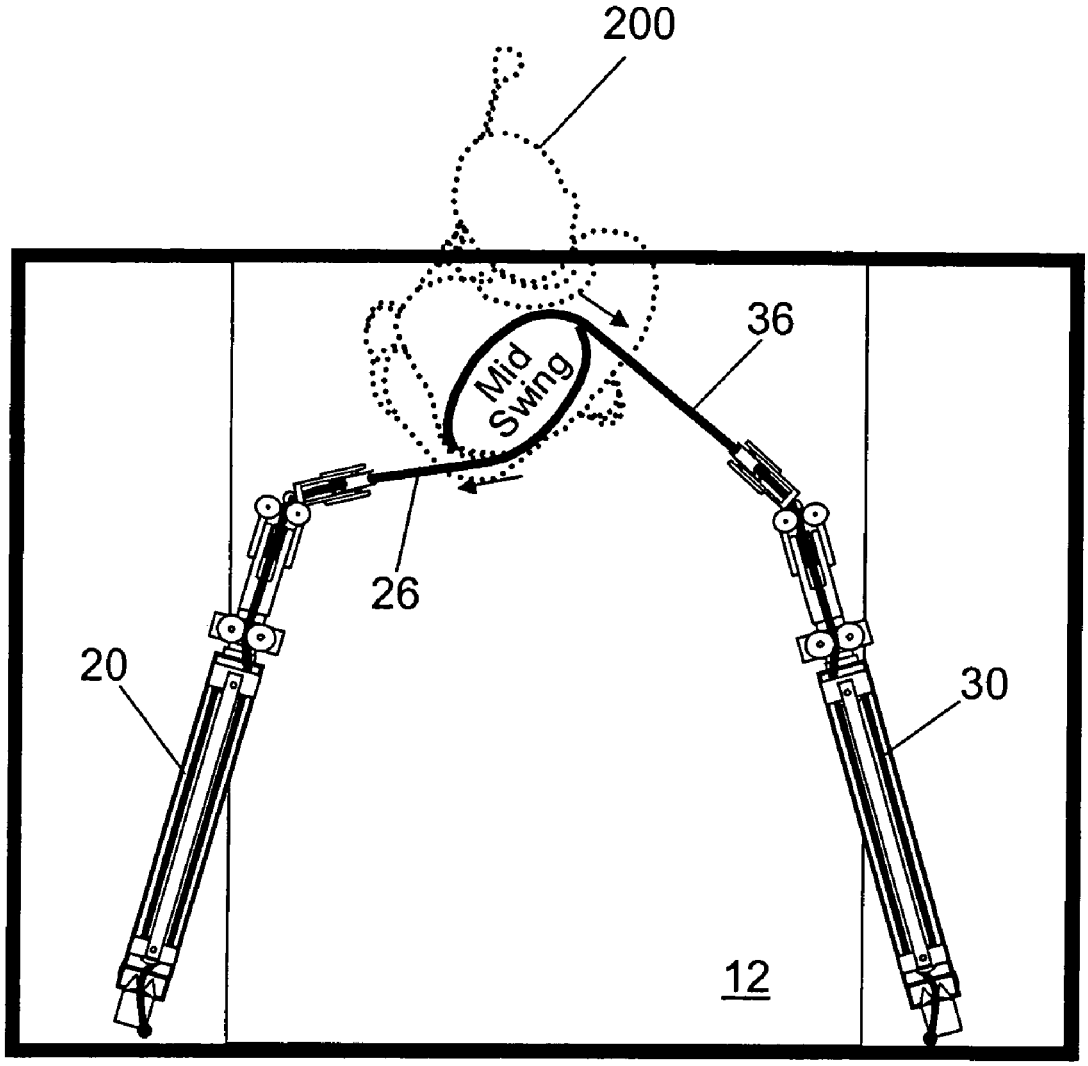
FIG. 14 is a top plan view of an embodiment of the present invention with a user in the mid-swing position of FIGS. 11 and 12 showing a restraining means providing a specified resistance with reference to the user.
Figure 15:
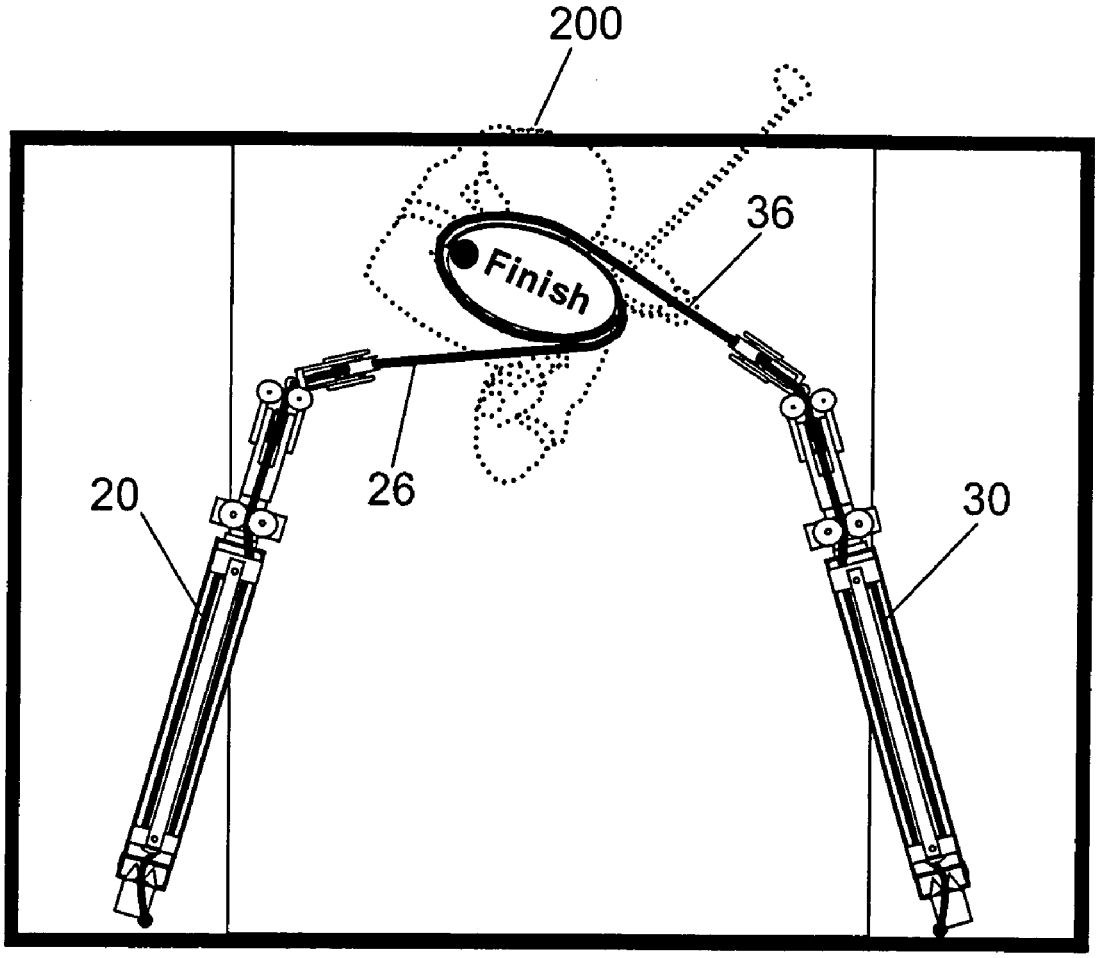
FIG. 15 is a top plan view of an embodiment of the present invention with a user in the follow-through position of FIGS. 11 and 12 showing a restraining means providing a specified resistance with reference to the user.

FIGS. 11 and 12 illustrate the various positions of the hips of a golfer during the golf swing. FIGS. 13-15 illustrate one embodiment of the physical training apparatus according to the present invention providing training vectors to a trainee 200 at various stages of performing the golf swing. With reference to FIGS. 13-15, the resistance training assemblies 20,30 are positioned so that the assembly 20 provides a training vector to the right hip of the trainee 200 by attaching the elastic member 26 to a harness (not shown) worn on the waist of the trainee. The assembly 30 provides a training vector to the left hip of the trainee 200 by attaching the elastic member 36 to the harness (not shown) worn on the waist of the trainee. As illustrated, the elastic members 26, 36 continually apply a force opposing the rotation of the hips of the trainee from the backswing position (FIG. 13) through the mid-swing position (FIG. 14) to the follow-through position (FIG. 15) of the golf swing.

Figure 16:
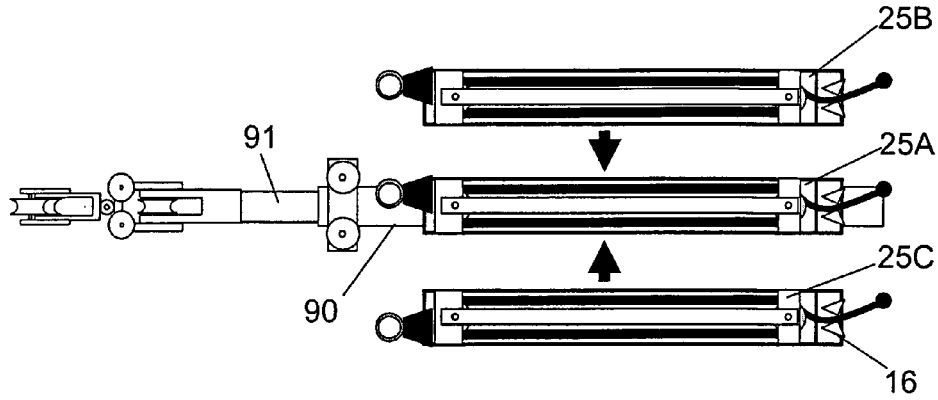
FIG. 16 is a top plan view of an alternative embodiment of the training module of FIG. 3 including an attachment means.
Figure 17:
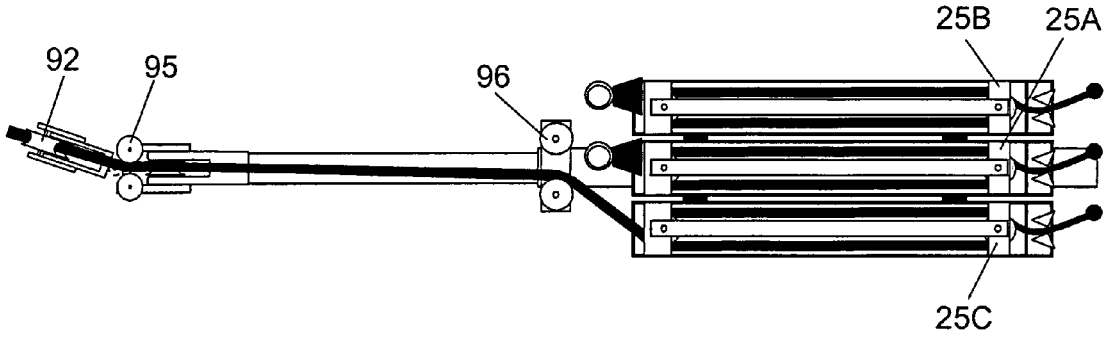
FIG. 17 is a top plan view of an alternative embodiment of the training module of FIG. 3.
Figure 18:
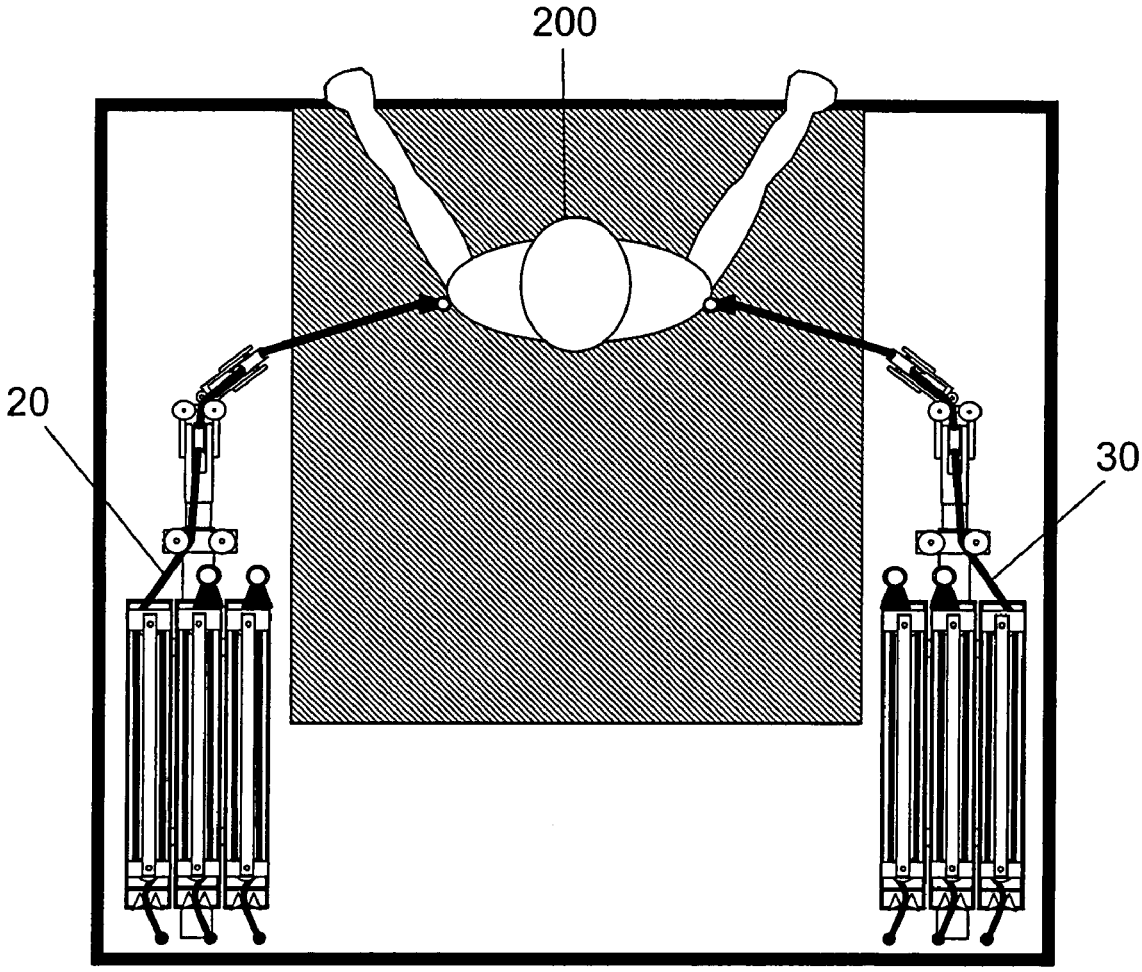
FIG. 18 is a top plan view of a further embodiment of the present invention with a user in a standing position showing an alternative resistance training assembly providing a specified resistance with reference to the user.

FIG. 16 shows a training module 25A including side attachment means so that additional training modules 25B and 25C may be easily attached or detached to the sides of training module 25A. The anchor 16 on each module enables the effective length of the elastic member in the module to be varied to thereby vary the magnitude of the force provided by the member. The range of variance is limited by the diameter of the elastic member. For example, the module 25A may include an elastic member with a diameter of ⅜ inches. The effective length of the elastic member may be varied to thereby vary the force provided by the elastic member in the range between about twenty and about forty pounds. By adding a second module 25B including an elastic member with a smaller diameter resistance band (e.g., a diameter of about 5⁄16 inches) would provide a useful resistance force range from about four to about twenty pounds. By adding another module 25C including an elastic member with a larger diameter (e.g., a diameter of ½ inches) would provide a useful resistance force range from about thirty-five to about sixty pounds. Thus, by adding the modules 25B and 25C the effective range of resistance forces is expanded to the range between about four pounds to about sixty pounds. Without the ability to attach and detach additional modules, one would have to remove and then completely replace the resistance band to provide a lower or higher range of training resistances. FIG. 18 illustrates resistance training assemblies 20 and 30 comprising training modules 25A,25B,25C.

Figure 19:
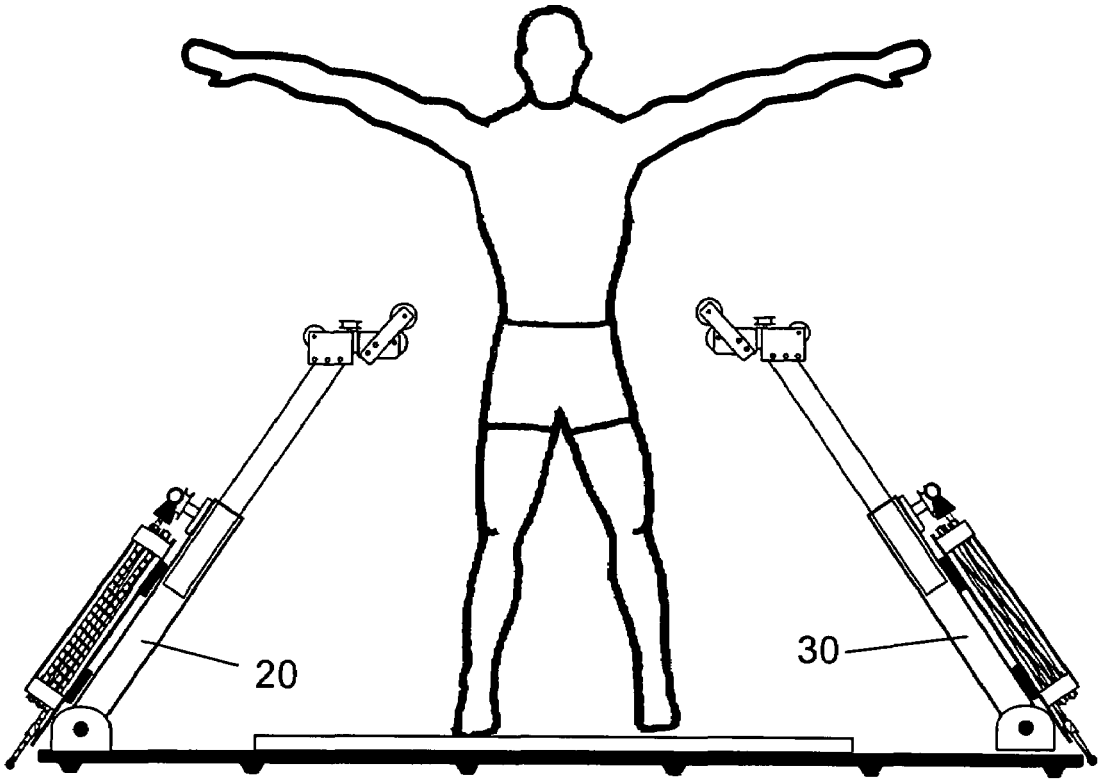
FIG. 19 is a front view of an embodiment of the present invention showing resistance training assemblies directly to the left and right of a user.
Figure 20:
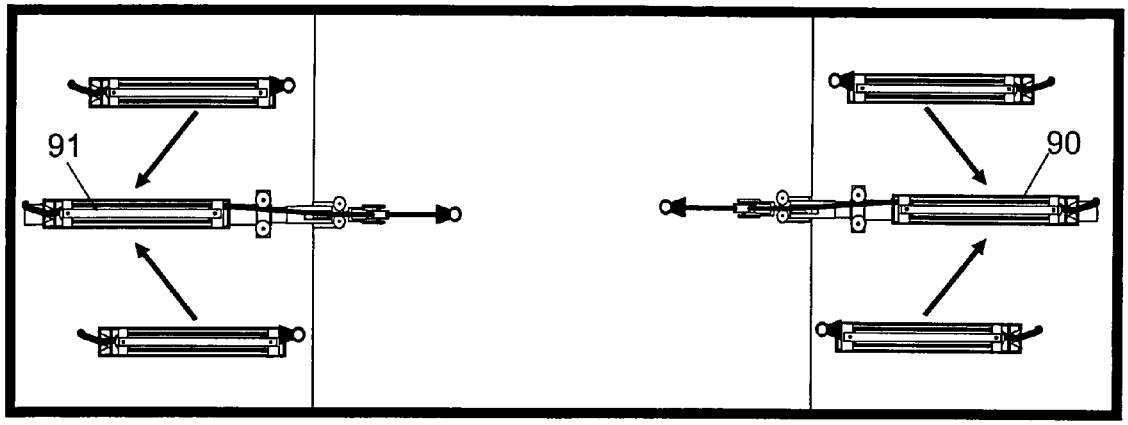
FIG. 20 is a top plan view of the embodiment of FIG. 19 showing an alternative resistance training assembly.
Figure 21:
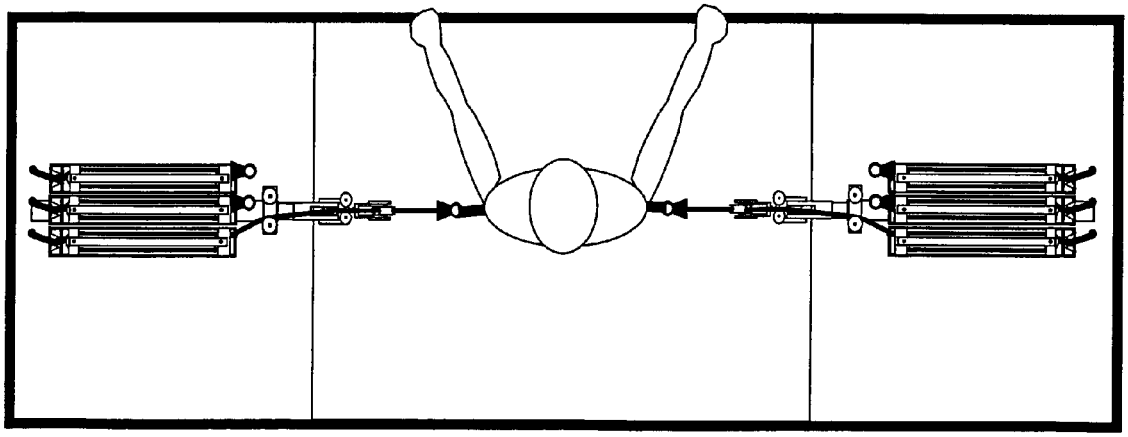
FIG. 21 is a top plan view of FIG. 20 with a user in a standing position showing a restraining means providing a specified resistance with reference to the user.

FIG. 19 illustrates an embodiment of the physical training apparatus according to the present invention wherein the resistance training assemblies 20,30 are mounted directly to the left and right of the trainee 200. FIGS. 20 and 21 illustrate the positioning of the resistance training assemblies 20 and 30 including the triple training module configuration.

Figure 22:
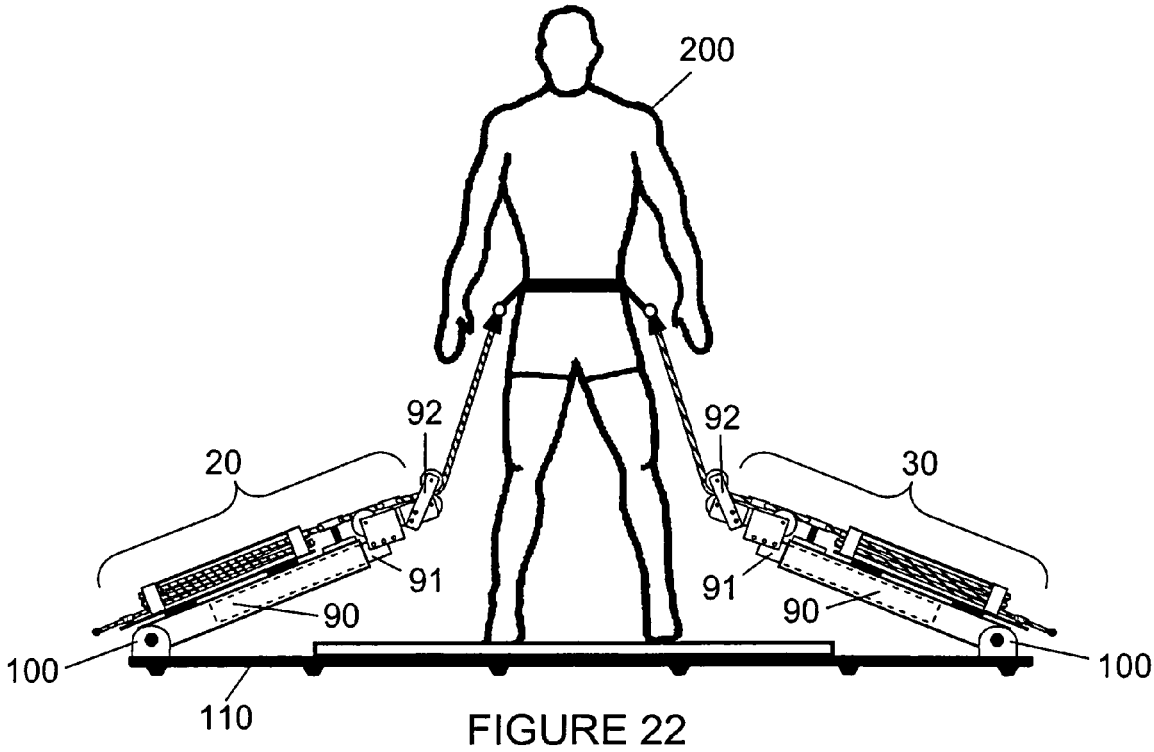
FIGS. 22 and 23 are front views of various embodiments of the present invention illustrating alternative positions of the resistance training assembly.
Figure 23:
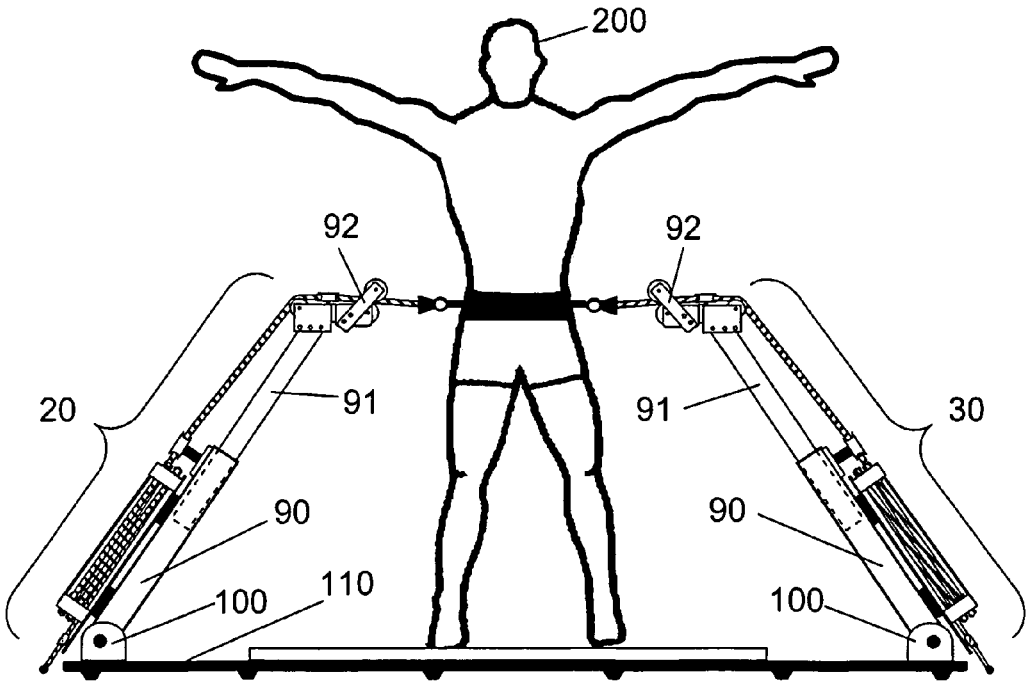

FIGS. 22 and 23 illustrate two of many positions of the resistance training assemblies 20,30. The base fixture 100 for each assembly provides an adjustment means to lock frame member 90 in various angular positions relative to the exercise frame 110, allowing the angular position of assemblies 20,30 to be set at many positions. Note also that frame member 90 has a mechanical adjustment means to fix the position of telescoping member 91 (which slides within 90) at various telescopic positions.

Figure 24:
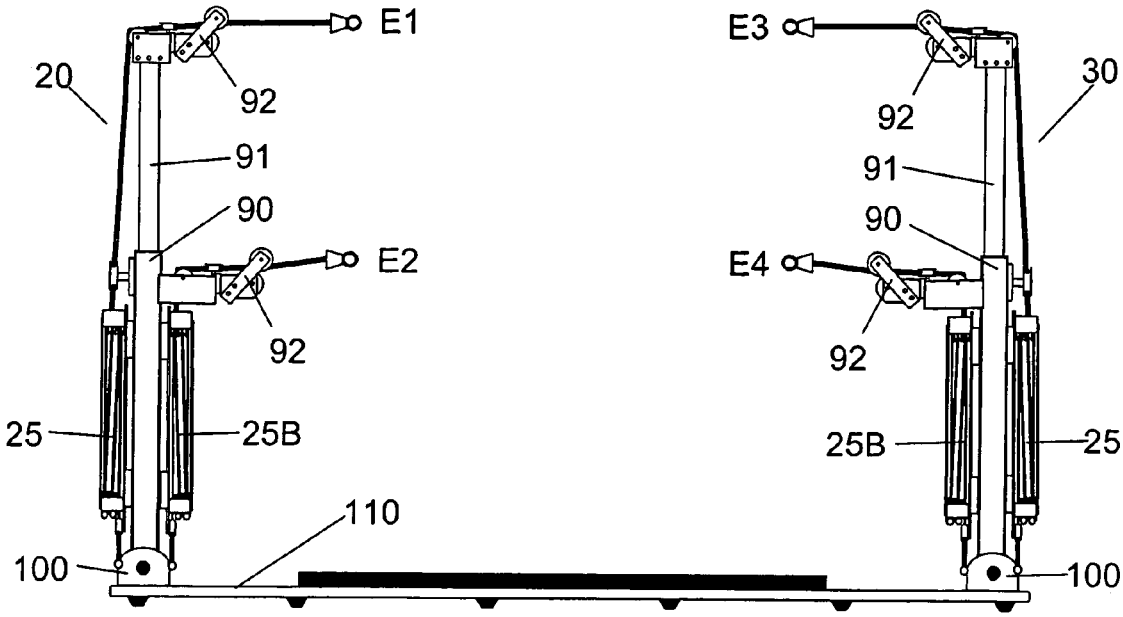
FIGS. 24 and 25 are front views of alternative embodiments of the present invention providing four training vectors to a user.

FIG. 24 illustrates a physical training apparatus providing four training vectors by attaching training modules 25A and 25B to each frame member 90 of the respective assemblies 20,30 and attaching an additional pivoting pulley assembly 92 to each frame member 90. This embodiment provides elastic members E1,E2,E3,E4 for attachment to the trainee so that training vectors may be applied to two points on the trainee in addition to the hips.

Figure 25:
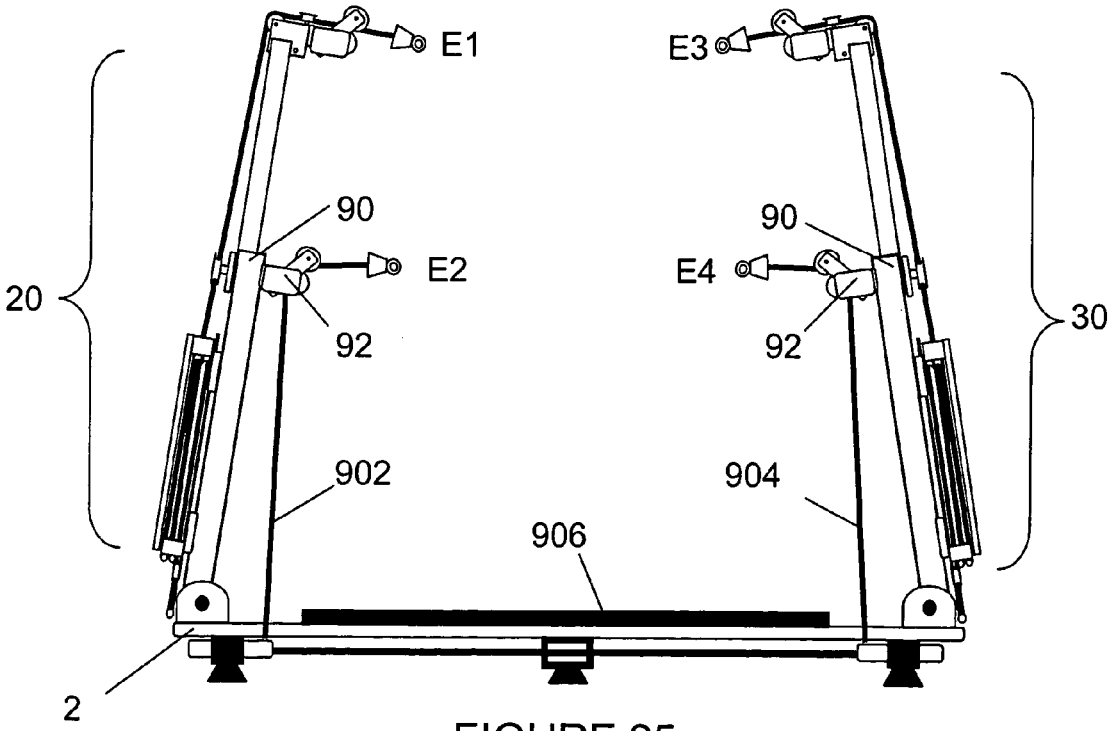
Figure 26:
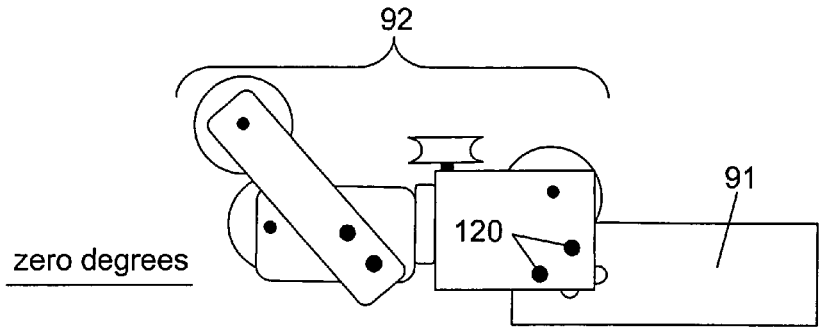
FIG. 26 is a side view of a pulley assembly of the present invention level with a member.
Figure 27:
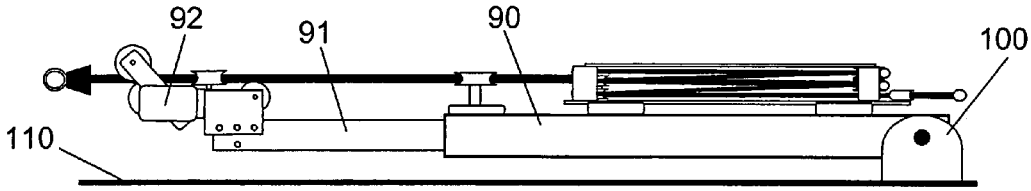
FIG. 27 is a side view of the pulley assembly of FIG. 26 attached to a resistance training assembly.
Figure 28:
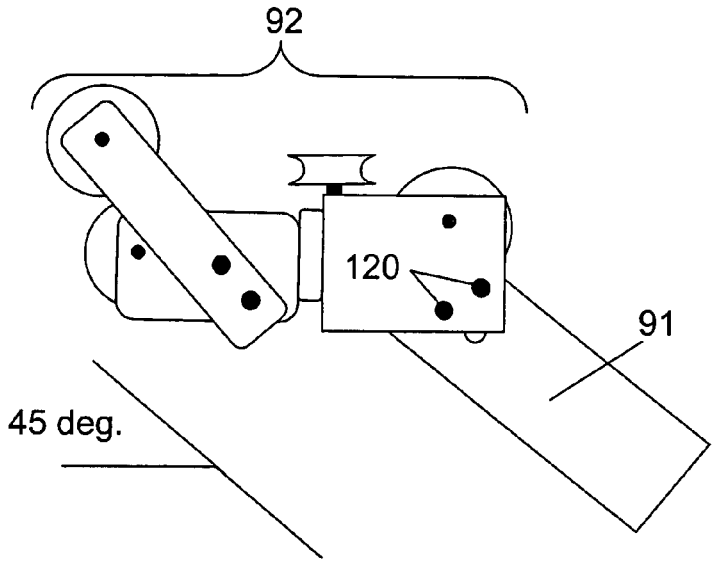
FIG. 28 is a side view of a pulley assembly of the present invention pivoted at a 45 degree angle relative to a member.
Figure 29:
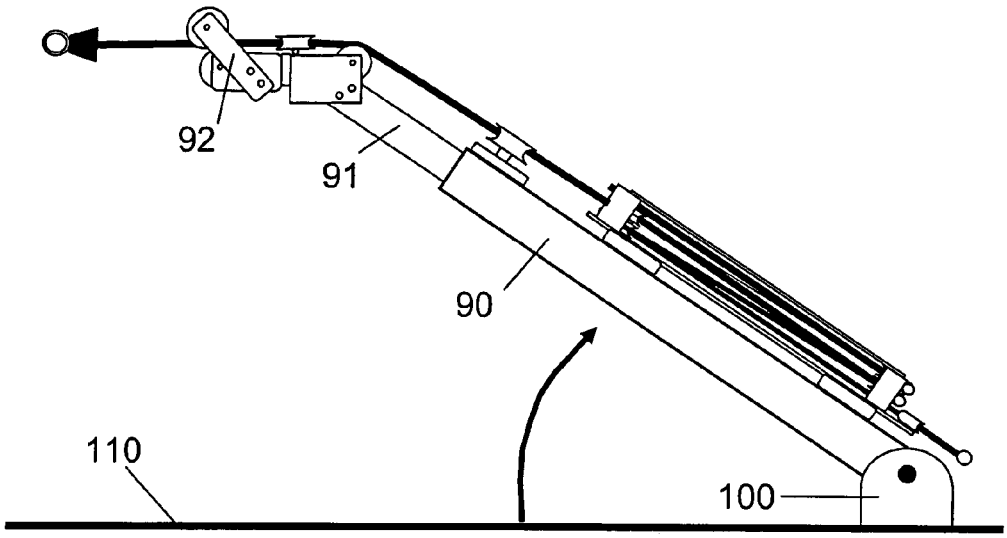
FIG. 29 is a side view of the pulley assembly of FIG. 28 attached to a resistance training assembly.
Figure 30:
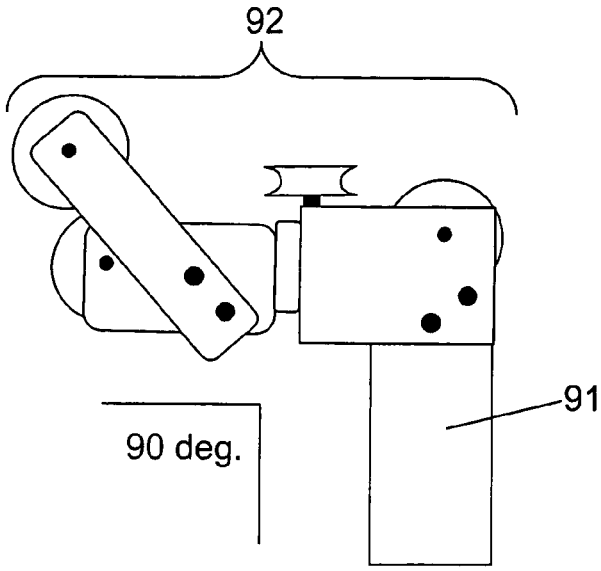
FIG. 30 is a side view of a pulley assembly of the present invention pivoted at a right angle relative to a member.
Figure 31:
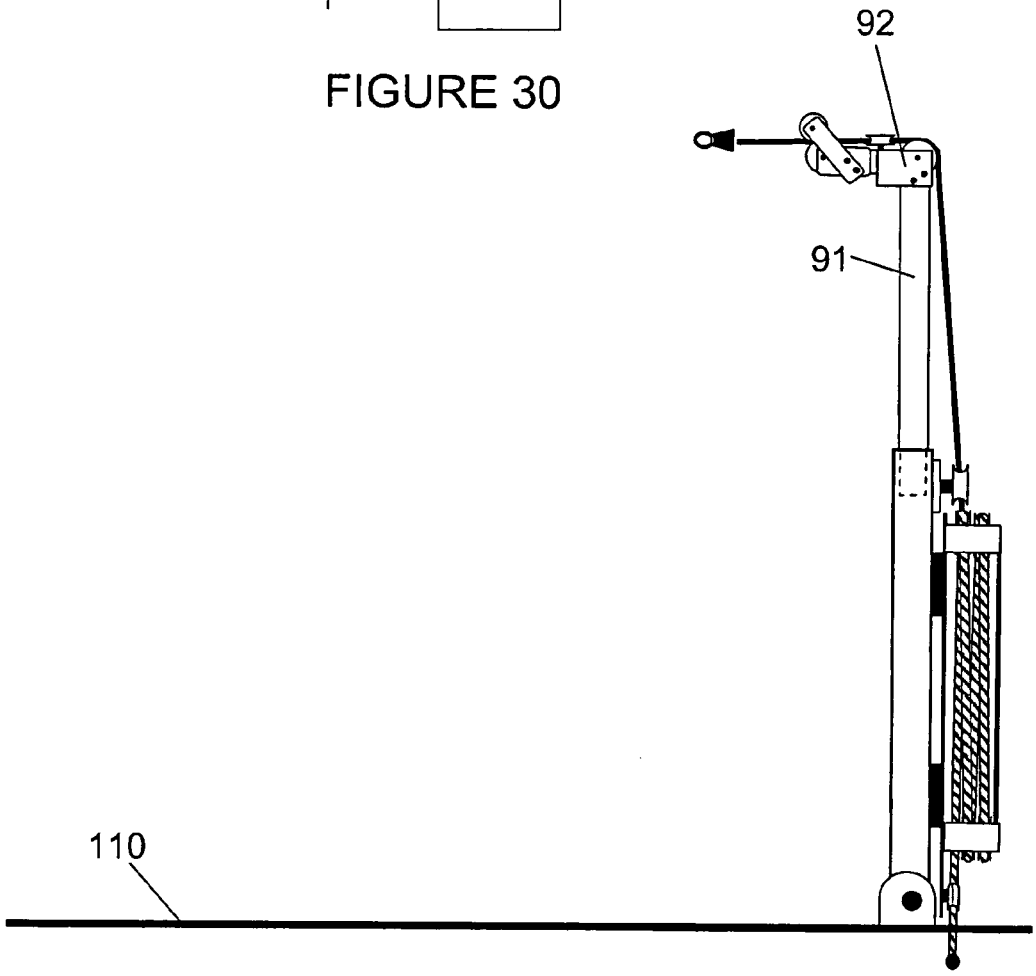
FIG. 31 is a side view of the pulley assembly of FIG. 30 attached to a resistance training assembly.
Figure 32:
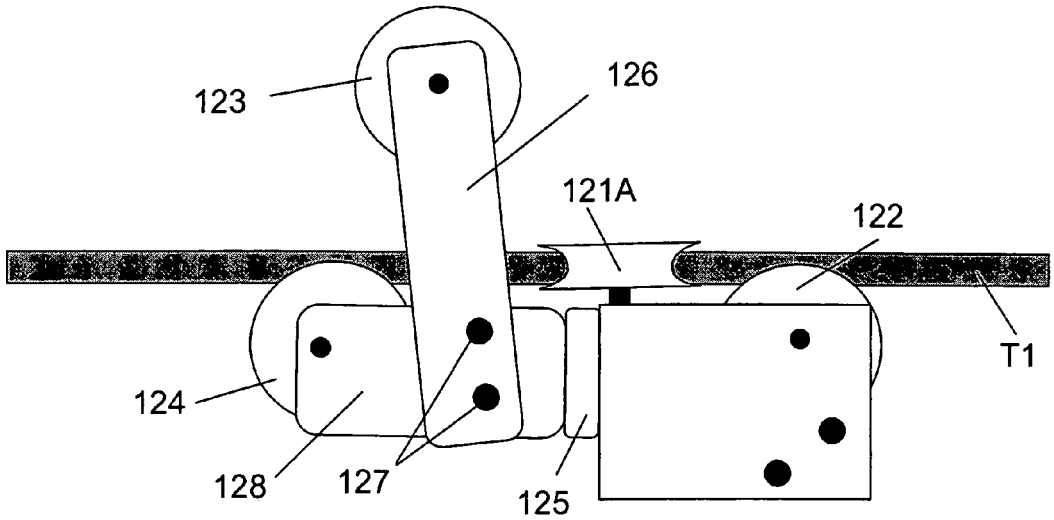
FIGS. 32-35 are illustrations of the pulley assembly of FIGS. 26, 28 and 30 depicting pivoting points of the pulley assembly.

FIG. 25 illustrates another embodiment for providing four training vectors by using the elastic members 902,904 (which may be directed away from the training surface 906 as disclosed in the prior Wehrell patents) and directing the members 902,904 through the respective pivoting pulley assembly 92.

FIGS. 26-31 illustrate the pivoting capabilities of the pulley assembly 92. As the assembly 92 is elevated by pivoting the member 90 about the base fixture 100, the position of the pivoting pulley assembly 92 relative to member 91 may be adjusted. Adjustment means 120 may be provided as necessary to position the assembly 92 at the desired angles relative to member 91.

Figure 33:
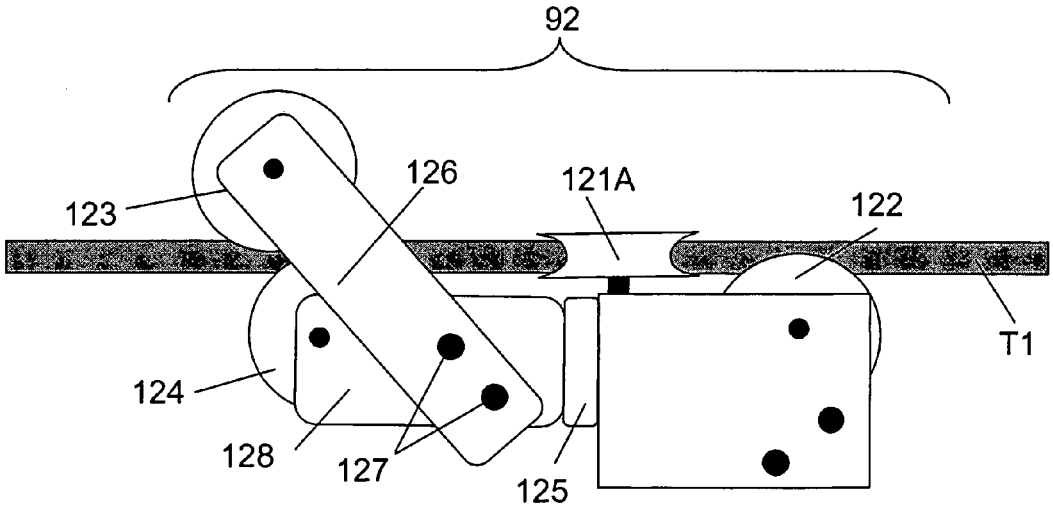

FIGS. 32-35 illustrate the operational features and pivoting point of the pulley assembly 92. With reference to FIGS. 32-35, the tether T1 is routed through the pulley 122 and between horizontal pulleys 121A and 121B. An adjustment mechanism 127 enables the support structure 126 for the pulley 123 to rotate clockwise to separate the pulley 123 from the pulley 124. This allows tether T1 to be placed over pulley 124. With reference to FIG. 33, the support structure 126 is then rotated counter clockwise until it binds tether T1 firmly within the races of the pulleys 124 and 123. Locking mechanism 127 secures 126 in place so the pulleys 123 and 124 can not separate. The tight special separation between the pulleys 123 and 124 prohibit tether T1 from derailing from the pulleys 123 and 124 during movement of the tether T1. The tether T1 may be any means for providing a training vector to a trainee such as an elastic member.

Figure 34:
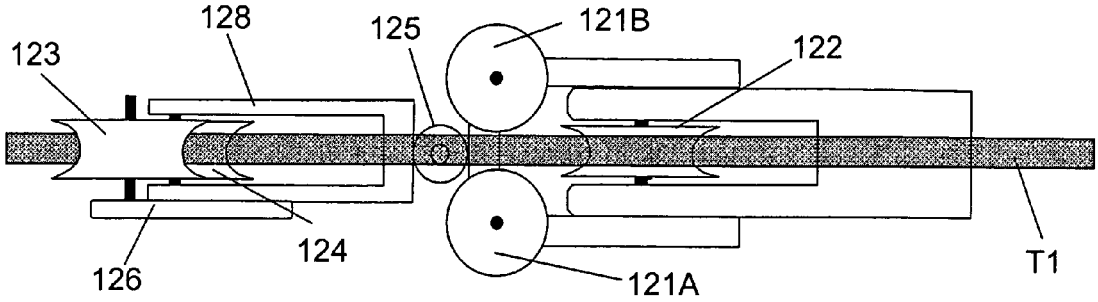
Figure 35:
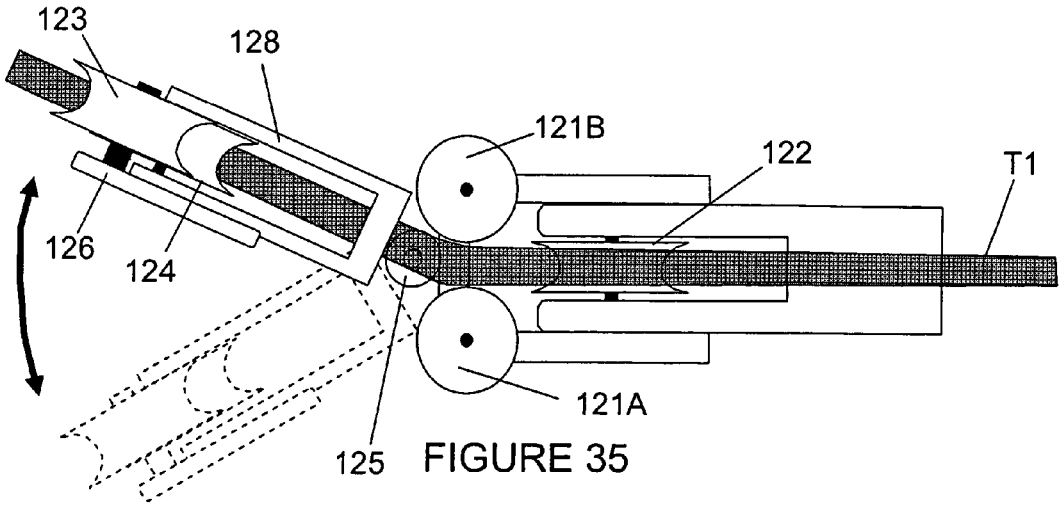

With reference FIGS. 34 and 35, it can be seen that the purpose of pulleys 121A and 121B are to maintain the tether T1 on pulley 122 when the rotating assembly 128 pivots about the mechanical axis 125. This assembly allows the user to move the tether over a wide range of points within the exercise area (180 degrees left and right, and 180 degrees up and down) without the tether derailing from the pulley assembly 92.

It can be seen from the various figures illustrating many of the embodiments of the physical training apparatus according to the present invention that the physical training apparatus may be used in a variety of configurations and is particularly suitable fro providing resistance to the rotation of the hips and other body parts during sports specific movements, e.g, the golf or baseball swing.

While preferred embodiments of the present invention have been described, it is to be understood that the embodiments described are illustrative only and that the scope of the invention is to be defined solely by the appended claims when accorded a full range of equivalence, many variations and modifications naturally occurring to those of skill in the art from a perusal hereof.

What is claimed is:

1. A swing training apparatus comprising:

a base forming a surface supporting a trainee;

a harness adapted to be worn by the trainee for providing attachment devices positioned at each hip of the trainee;

a pair of modules carried by said base for providing a training vector opposing the rotation of each hip of the trainee, each said module comprising:

an elastic member secured at one end to an anchor and attached at the other end to a connector device;

an elongated rigid frame movably fixed at one end to said base, the other end being selectively moveable in three dimensions and forming the origin of the training vector provided by said module; and a plurality of tracking mechanisms carried by said frame for directing said elastic member from said connector device to the anchor, said connector device of one elastic member being attached to one of said attachment device and said connector device of the other elastic member being attached to the other attachment device for providing a training vector to each hip opposing rotation of the hip.

2. The swing training apparatus of claim 1 wherein the elastic member from the training module positioned to the left of the trainee is attached to the attachment device on the right hip of the trainee and the elastic member from the training module positioned to the right of the trainee is attached to the attachment device on the left hip of the trainee.

3. The swing training apparatus of claim 1 wherein each module is attached to the said base rearward of the trainee.

4. The swing training apparatus of claim 1 wherein each module is attached to said base lateral to the trainee.

5. The swing training apparatus of claim 1 wherein each module is attached to an elongated frame member forming a resistance training assembly.

6. The swing training apparatus of claim 5 wherein said frame member is telescoping.

7. The swing training apparatus of claim 1 wherein the effective length of the elastic members may be varied to thereby vary the magnitude of the training vector provided thereby.

8. The swing training apparatus of claim 1 further comprising means for applying training vectors to other parts of the trainee in addition to the hips.

9. A swing training apparatus comprising:

attachment devices positioned at each hip of a trainee;

a pair of modules for providing a training vector opposing the rotation of each hip of the trainee, each said module comprising:

an elastic member secured at one end to an anchor and attached at the other end to a connector device;

an elongated rigid frame fixed at one end, the other end being selectively moveable and forming the origin of the training vector provided by said module; and a plurality of tracking mechanisms carried by said frame for directing said elastic member from said connector device to the anchor, said plural tracking mechanisms being in direct contact with said elastic member to provide a path for routing said elastic member from said connector device to said anchor, said connector device of one elastic member being attached to one of said attachment devices and said connector device of the other elastic member being attached to the other attachment device for providing a training vector to each hip opposing rotation of the hip.

10. The swing training apparatus of claim 9 further comprising a base forming a surface supporting the trainee.

11. The swing training apparatus of claim 10 wherein said elongated rigid frame is movably fixed at said one end to said base.

12. The swing training apparatus of claim 9 wherein said other end is selectively moveable in three dimensions.

13. The swing training apparatus of claim 9 wherein a harness provides at least one of said attachment devices.

14. The swing training apparatus of claim 9 wherein at least one of said tracking mechanisms comprises a plurality of pulley mechanisms carried by said module for said elastic member from the anchor at one end to the connector device at the other end.

* * * * *